US010273081B2

(12) United States Patent
Cramer et al.

(10) Patent No.: US 10,273,081 B2
(45) Date of Patent: Apr. 30, 2019

(54) CINCH HANDLES, RECEPTACLES, AND METHODS

(71) Applicant: Rubbermaid Commercial Products LLC, Winchester, VA (US)

(72) Inventors: Earle Cramer, Portage, MI (US); Allison Hammer, Chicago, IL (US); Monica Lichty, Kalamazoo, MI (US)

(73) Assignee: Rubbermaid Commercial Products LLC, Winchester, VA (US)

( * ) Notice: Subject to any disclaimer, the term of this patent is extended or adjusted under 35 U.S.C. 154(b) by 0 days.

(21) Appl. No.: 15/169,070

(22) Filed: May 31, 2016

(65) Prior Publication Data

US 2017/0341858 A1 Nov. 30, 2017

(51) Int. Cl.
*B65F 1/06* (2006.01)

(52) U.S. Cl.
CPC ..... *B65F 1/06* (2013.01)

(58) Field of Classification Search
CPC ..... B65F 1/06; B65F 1/04; B65F 1/08
USPC ..... 220/908.1, 908, 495.11
See application file for complete search history.

(56) References Cited

U.S. PATENT DOCUMENTS 3,817,563 A * 6/1974 McGlothlin ..... B65F 1/1615 220/318
3,825,150 A 7/1974 Taylor
4,027,774 A 6/1977 Cote
4,923,087 A * 5/1990 Burrows ..... B65F 1/06 220/495.1
5,261,553 A 11/1993 Mueller et al.
5,636,416 A 6/1997 Anderson
5,695,088 A * 12/1997 Kasbohm ..... B65D 25/16 220/495.11
D401,383 S 11/1998 Gish
7,980,411 B2 7/2011 Kasbohm
8,807,381 B2 8/2014 Wentz et al.
9,079,711 B2 7/2015 Pho et al.
2007/0202751 A1* 8/2007 Wentz ..... B65F 1/06 439/675
2008/0197136 A1 8/2008 Dukes
2008/0272127 A1 11/2008 Kovacevich et al.

FOREIGN PATENT DOCUMENTS

WO 2007092486 A1 8/2007

* cited by examiner

*Primary Examiner* — Jeffrey R Allen
(74) *Attorney, Agent, or Firm* — Eversheds Sutherland (US) LLP

(57) ABSTRACT

Embodiments of the disclosure can include cinches, receptacles, and associated methods. In one embodiment, a cinch can include a base member configured to be attached to a body of a receptacle, a first member that can be substantially parallel to the base member, and a second member that can extend outwardly from the base member and is substantially transverse to the first member, wherein the inner surfaces of the base, first, and second members can define a handle. A slot for retaining a flexible liner can extend from the inner to the outer surface of the first member and a through-hole in the second member can be configured to receive the flexible liner.

20 Claims, 12 Drawing Sheets

CINCH HANDLES, RECEPTACLES, AND METHODS

TECHNICAL FIELD

This disclosure relates to waste receptacles. More particularly, the disclosure relates to a receptacle having a cinch handle that permits a flexible liner to be connected to the receptacle and a method of using the same.

BACKGROUND

Receptacles or containers for refuse are available in a number of different sizes, and useful for a variety of applications. For example, receptacles are commonly used for disposal of trash, grass, leaves, and other materials, and may be used in both commercial and residential applications.

Flexible liners are often used in combination with the receptacles to simplify emptying of the receptacles and disposal and transportation of the filled flexible liner. Flexible liners may, for example, be composed of an elastic or deformable material, such as polyliner or trash bags, that will conform to the shape of the receptacle. However, flexible liners may be difficult to maintain in the receptacle as the receptacle and flexible liner are filled with material. For example, flexible liners may fall into the receptacle during the filling process, creating inconvenience and difficulty for the user.

To maintain flexible liners properly disposed in the receptacle, receptacle bodies may include a cinch formed on the body. These cinches are integral to the receptacle body, and are not removable. Additionally, such integral cinches can be composed of the same material as the corresponding receptacle body, and produced to be the same color as the receptacle body. Accordingly, certain cinches may be difficult for a user to distinguish from the receptacle, so a user may fail to notice the cinch, and secure the flexible liner to the receptacle without use of the cinch. Further, receptacles with integral cinches usually require separate handles disposed on the body of the receptacle, which may be adjacent to or attached to the cinch or cinches.

SUMMARY

Embodiments of the disclosure can include cinch handles, receptacles, and associated methods. In certain embodiments of the disclosure, a receptacle having a cinch handle that permits a flexible liner to be connected to the receptacle and a method of using the same can be provided. In at least one embodiment, a cinch handle can be provided. The cinch can include a base member configured to be attached to a body of a receptacle, a projection disposed outward from the base member which has a first member substantially parallel to the base member, and a second member outwardly extending from the base member and substantially transverse to the first member, wherein the first member is connected to the second member and the second member is connected to the base member, wherein each of the base, first, and second members has opposing outer and inner surfaces such that the inner surface of the base member faces the first member, the inner surface of the first member faces the base member, and the inner surface of the second member faces a space defined by the base member, first member, and second member, and wherein the inner surfaces of the base member, first member, and second member define a handle. The cinch can further include a slot extending from the inner surface to the outer surface of the first member, wherein the slot has an open end at a bottom edge of the first member, a closed end disposed between the bottom edge and a top edge of the first member, and two side edges extending between the open end and the closed end, wherein the two side edges of the slot are substantially parallel to one another such that at least one portion of a flexible liner positioned the body of the receptacle is disposable and retainable within the slot by the two side edges. The cinch can further include a through-hole in the second member that is configured to receive a portion of the flexible liner adjacent the at least one portion of a flexible liner disposed and retained within the slot.

In another embodiment of the disclosure, a receptacle is provided. The receptacle can have a body configured to receive a flexible liner and a cinch disposed on the body. The cinch can be a handle as described above.

In yet another embodiment of the disclosure, a method of using a receptacle can be provided. The method can include inserting a flexible liner into a body of the receptacle, pulling the flexible liner taut around a rim of the body so as to create a bunched portion from resulting slack, disposing at least one portion of the bunched portion of the flexible liner through the through-hole in the second member and between the slot and the body before disposing the at least one portion of the bunched portion of the flexible liner within the slot, and disposing the at least one portion of the bunched portion of the flexible liner between the two side edges of the slot such that the at least one portion of the bunched portion of the flexible liner is retained within the slot.

Other embodiments, aspects, devices, and methods can be implemented within the scope of the disclosure.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. In some figures, the relative size of certain elements and/or components exaggerated for ease of illustration. Throughout this disclosure, depending on the context, singular and plural terminology may be used interchangeably.

DETAILED DESCRIPTION

Figure 1A:
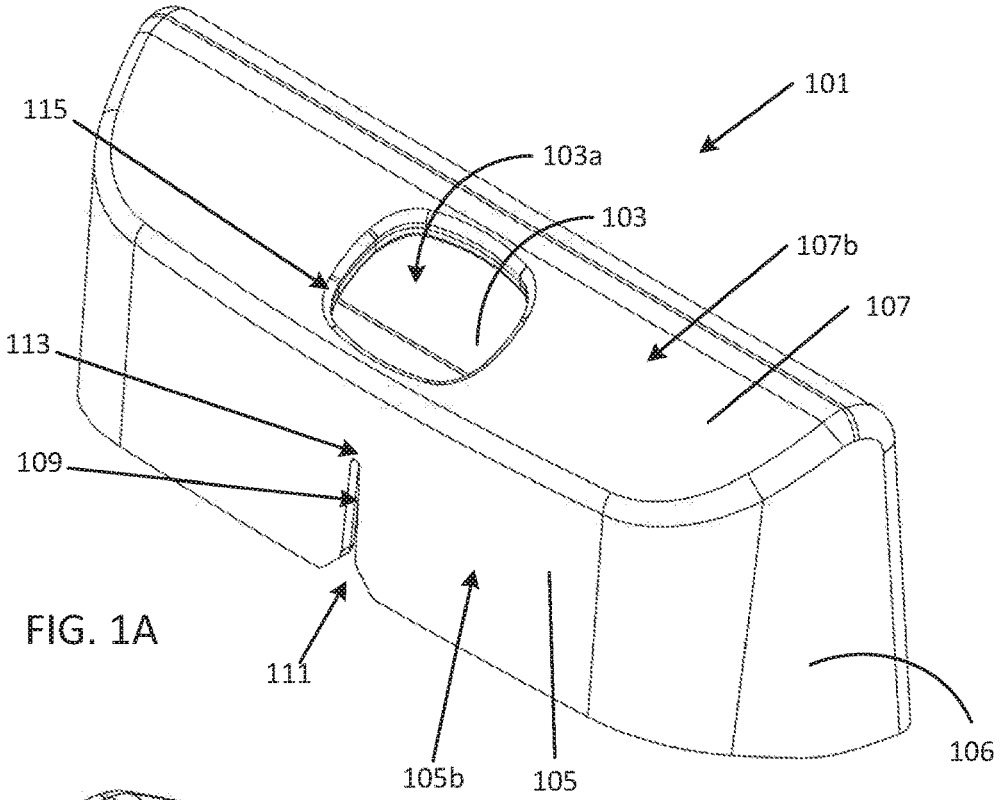
FIG. 1A is a front perspective a cinch according to a first embodiment.

Embodiments of the disclosure can include cinch handles, receptacles, and associated methods. In certain embodiments of the disclosure, a receptacle having a cinch handle that permits a flexible liner to be connected to the receptacle and a method of using the same can be provided. In other embodiments, improved cinches and receptacles have been developed for holding a flexible liner, as well as methods of using the same. In at least one embodiment, the cinch may be sized and shaped to be a handle for a user, such that a receptacle having a cinch disposed thereon may be lifted and moved by a user with his or her fingers inserted into the inner volume of the cinch. Additionally, according to certain embodiments, the cinches described herein are not integrally formed with the receptacles, but instead are separate from the receptacle such that they may be composed of different materials and attached to a receptacle during or after manufacture of the receptacle. In certain embodiments, the cinches disclosed herein are removable and/or replaceable.

According to certain embodiments, the flexible liner may be composed of any number of materials, including an elastic material or polymer. In some embodiments, the flexible liner may be configured to substantially conform to the shape of the receptacle. In some embodiments, the flexible liner is a trash bag. As used herein, the term "about" when used to modify a linear dimension, such as the length of an object, can refer to the dimension +/−10%. For example, the phrase "about 1 inch" shall be understood to encompass 1 inch +/−10%. As used herein, the term "substantially parallel" when used to describe the relative position of two members, can refer to the two members occupying planes that are parallel or generally parallel to one another. As used herein, the term "substantially transverse" when used to describe the relative position of two members, can refer to the two members occupying planes that are transverse or generally transverse to one another.

FIGS. 1A-1G show an embodiment of a cinch 101 that defines a handle. The cinch 101 can include a base member 103, which is configured to be attached to the body 119 of a receptacle 117. For example, the base member 103 may be configured with screw holes 114 extending through the base member 103, and through which one or more screws can be inserted to attach the cinch 101 to the body 119 of a receptacle 117. In other embodiments, the base member 103 may be formed to have or receive an adhesive suitable for attaching the cinch 101 to the body 119 of a receptacle 117. The base member 103 has an inner surface 103*a*, which, in use, faces away from the body 119 of the receptacle 117, and an outer surface 103*b*, which, in use, faces toward the body 119 of the receptacle 117. The base member 103 may be substantially planar, or alternatively, may be curved or faceted. For example, the base member 103 may be curved to match the curvature of the body of a receptacle 117, such as a round receptacle.

The cinch 101 can further include a first member 105, which is substantially parallel to the base member 103, and a second member 107, which extends outwardly from the base member 103 and is substantially transverse to the first member 105. In certain embodiments where the base member 103 is curved to match the curvature of the body of a receptacle 117, the first member 105 may be substantially planar, or be more planar than the base member 103 to better accommodate the fingers of a user. The second member 107 may lie in a plane substantially perpendicular to the base member 103 and/or first member 105, or may lie in a plane that is angled relative to the planes in which the base member 103 and/or first member 105 lie. For example, the second member 107 may lie in a plane that is angled from about 30 degrees to about 120 degrees relative to the planes in which the base member 103 and/or first member 105 lie.

The second member 107 has an inner surface 107*a* and an outer surface 107*b*. The first member 105 has an inner surface 105*a* and an outer surface 105*b*. The first member 105 is connected to the base member 103 via the second member 107.

In certain embodiments, the first member 105 can be connected to the base member 103 via the second member 107. For example, the first member 105 and the second member 107 may be connected or integrally formed along their respective edges, while the second member 107 and the base member 103 may be connected or integrally formed along their respective edges. For example, in some embodiments, the cinch may be formed of only the first member 105, the base member 103, and the second member 107, such that the cinch has a substantially U-shaped cross-section and open end portions (not illustrated). In other embodiments, as illustrated in FIGS. 1A-1G, side members 106 and 108 can connect to or can be integrally formed with the first member 105 (i.e., the portion of the cinch substantially parallel to the base member 103) and can further connect the first member 105 to the base member 103. In certain embodiments, the side members 106 and 108, in combination with the first member 105, the second member 107, and the base member 103, can form continuous outer and inner surfaces of the cinch.

In certain embodiments, as shown in FIGS. 1A-1G, the side members 106 and 108 can be substantially flush with the edges of the first member 105, the second member 107, and/or the base member 103. In other embodiments, as will be discussed in further detail with reference to FIGS. 5A-5B, the side members 529 and 531 may not be flush with the edges of the members, and instead can be spaced from the edges of the members.

In the embodiment illustrated in FIGS. 1A-1G, the side members 106, 108 are curved, such that the side members can form a flush outer surface between the first member 105 and the base member 103.

The first member 105 may be substantially planar, or alternatively may be faceted or have another suitable surface feature or contouring. Similarly, the second member 107 may be substantially planar, or alternatively, may be faceted or have another suitable surface feature or contouring. In certain embodiments, rounded or smoothed edge portions can connect the first member 105, the base member 103, the second member 107, and/or any side members 106, 108.

Figure 1B:
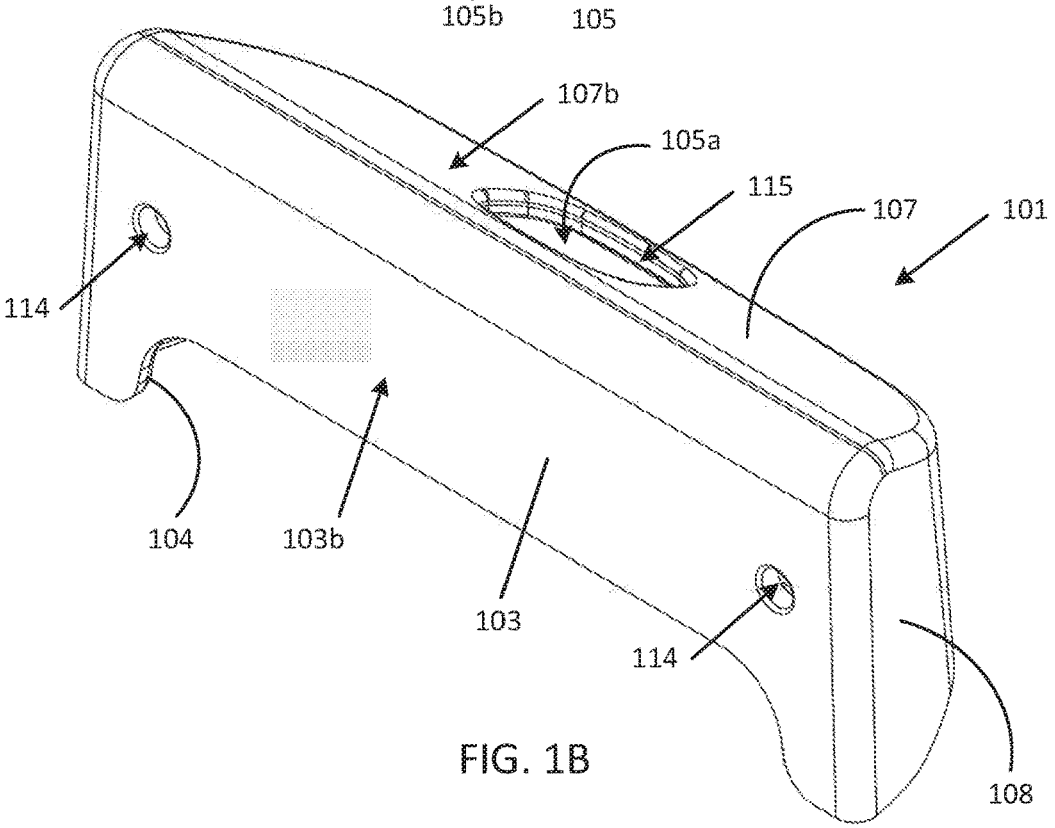
FIG. 1B is a rear perspective view of the cinch of FIG. 1A.
Figure 1C:
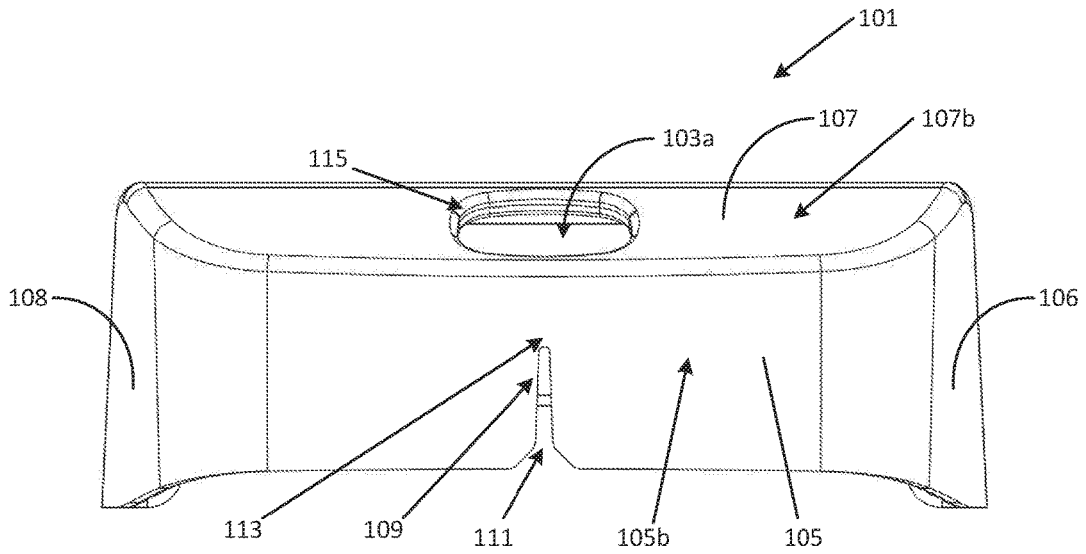
FIG. 1C is a front view of the cinch of FIG. 1A.
Figure 1D:
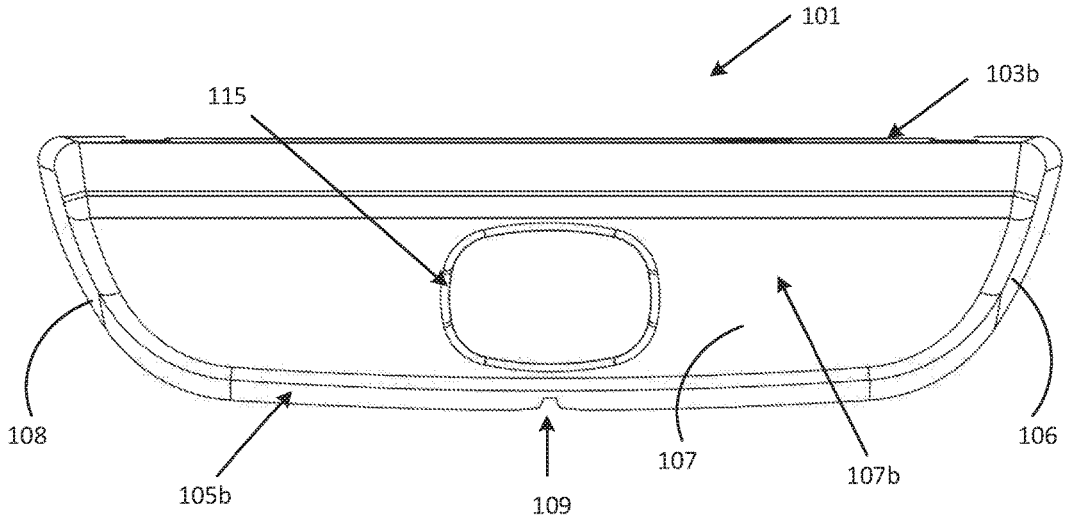
FIG. 1D is a top view of the cinch of FIG. 1A.
Figure 1E:
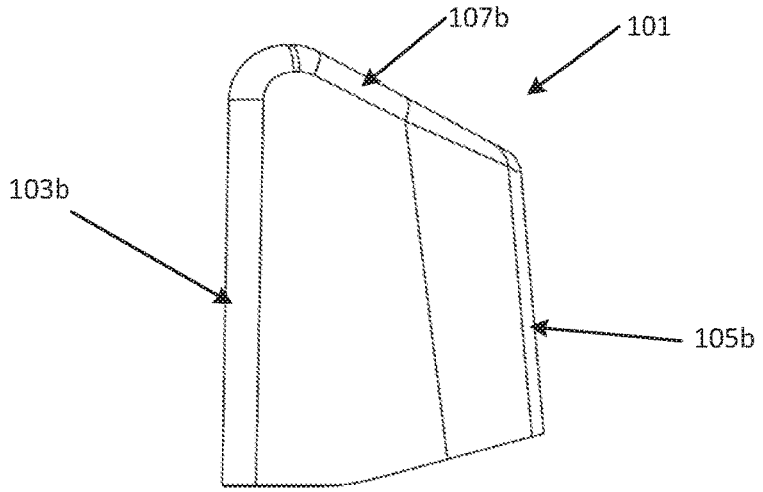
FIG. 1E is a side view of the cinch of FIG. 1A.
Figure 1F:
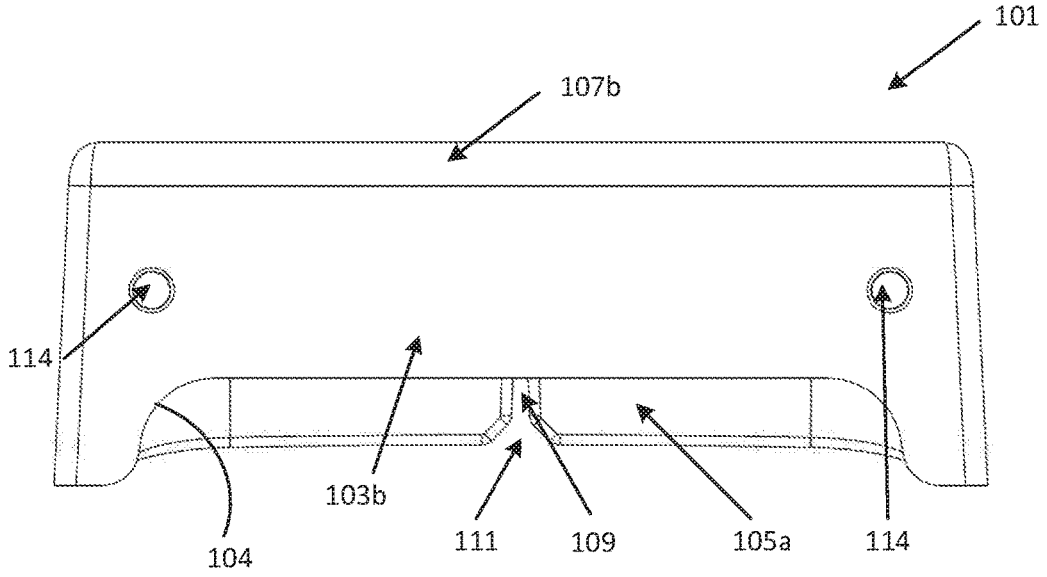
FIG. 1F is a rear view of the cinch of FIG. 1A.
Figure 1G:
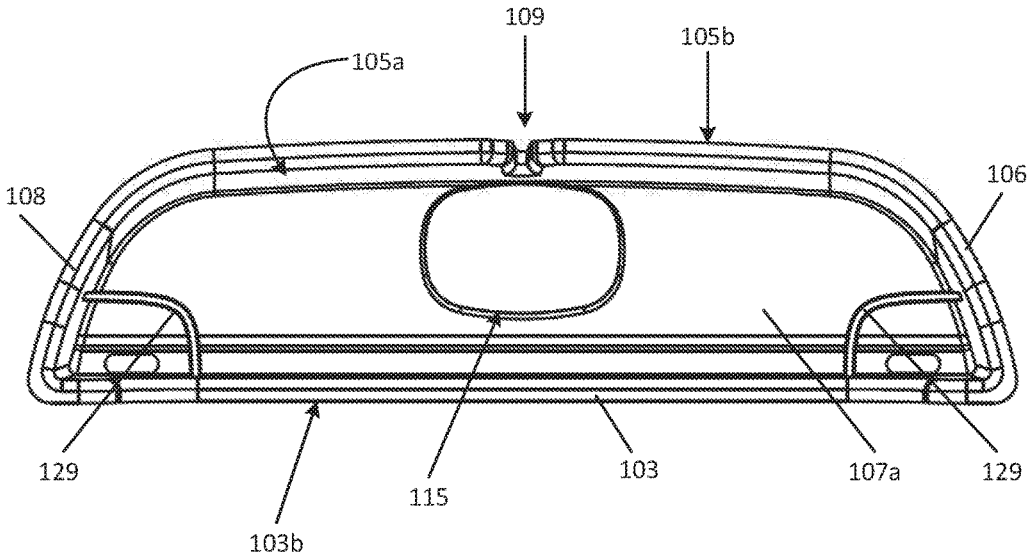
FIG. 1G is a bottom view of the cinch of FIG. 1A.
Figure 2A:
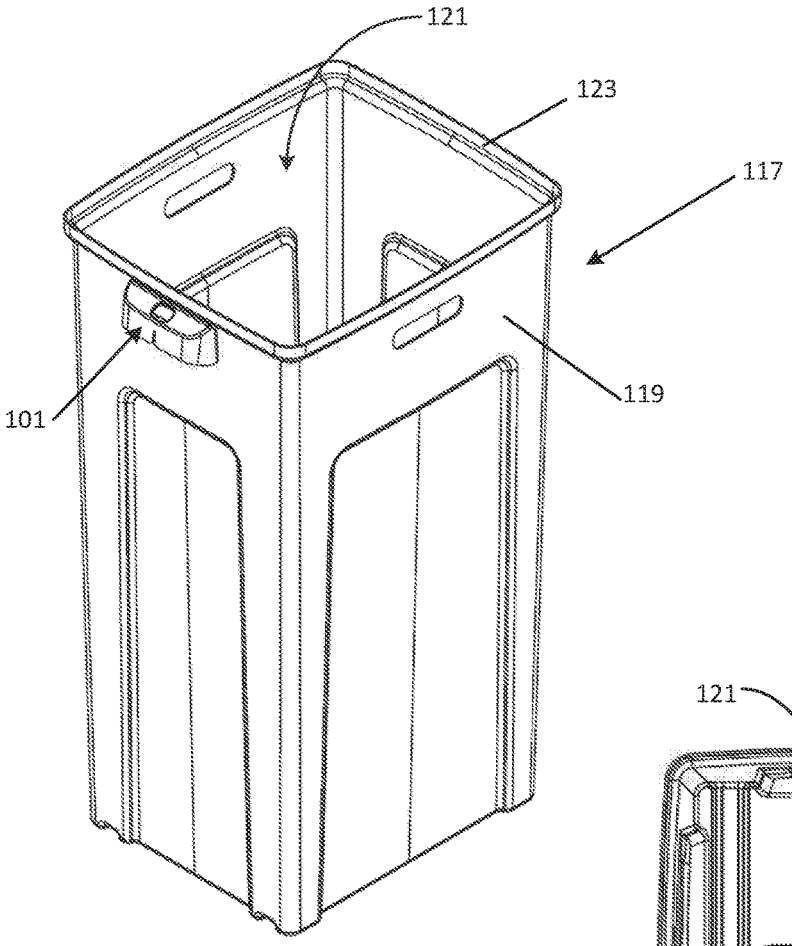
FIG. 2A is an upper perspective view of an embodiment of a receptacle having the cinch of FIGS. 1A-1G disposed thereon.
Figure 2B:
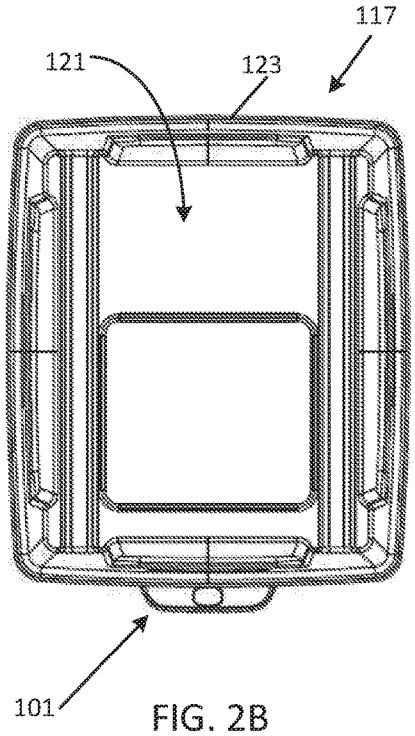
FIG. 2B is a top view of the receptacle of FIG. 2A.
Figure 2C:
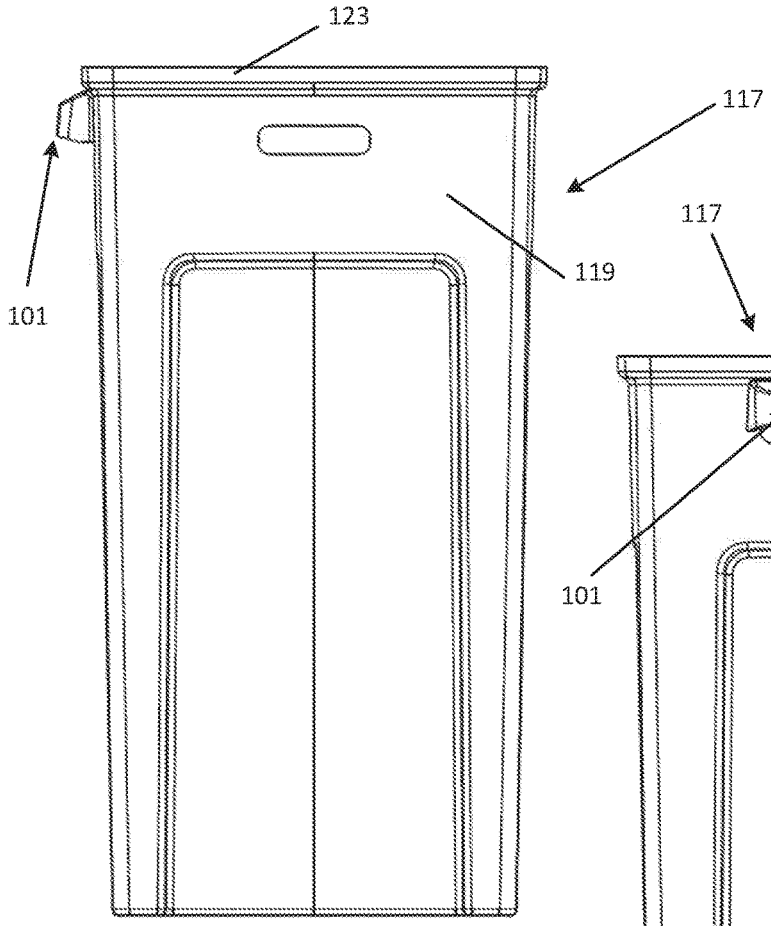
FIG. 2C is a side view of the receptacle of FIG. 2A.
Figure 2D:
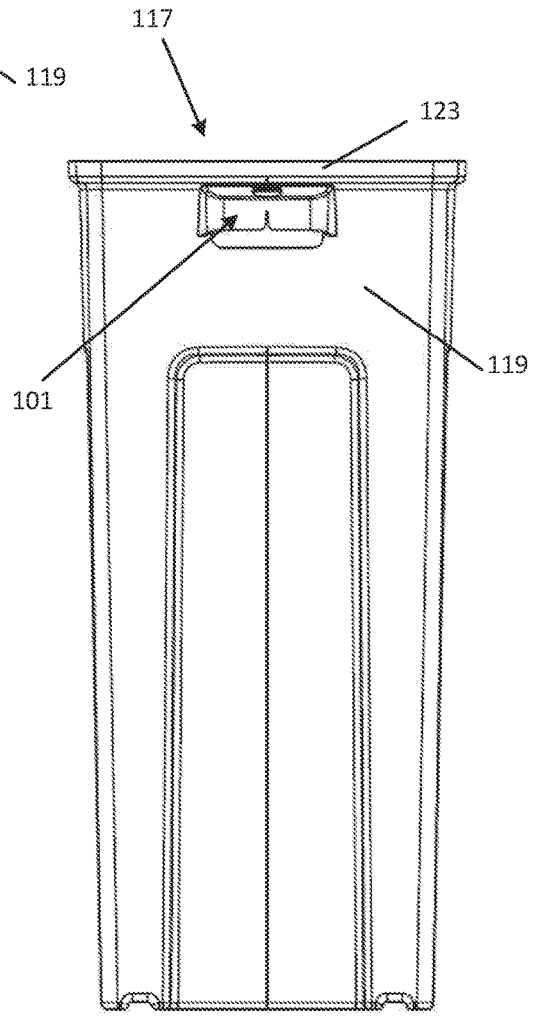
FIG. 2D is a front view of the receptacle of FIG. 2A.

The inner surfaces 103*a*, 105*a*, and 107*a* of the cinch 101 can define a handle. In some embodiments, the base member 103 may, at least in certain portions, have a height that is shorter than the first member 105, or may not extend along the entire width of the cinch 101. In these embodiments, it will be understood that the volume of the handle can be defined by the inner surfaces 105*a*, 107*a*, 103*a*, and a plane extending perpendicularly from the inner surface 105*a* at its open edge to a plane aligned with the inner surface 103*a*. For example, as shown in FIGS. 1B and 1F, the base member 103 may have a curved or notched bottom edge 104, such that, at least in certain portions along the cinch 101, the base member 103 is shorter than the first member 105. Thus, in these embodiments, it will be understood that the handle can be defined by the inner surfaces 105*a*, 107*a*, 103*a*, and a plane extending perpendicularly from the inner surface 105*a* at its open edge to a plane aligned with the inner surface 103*a*, such that the handle can be defined by a volume which, at least in some portions along the cinch 101, extends beyond the bottom edge 104 of the base member 103.

In the embodiment shown, the cinch 101 can further include a slot 109, which can extend from the outer surface 105*b* to the inner surface 105*a* of the first member 105. The slot 109 can further have an open end 111 and a closed end 113. The cinch 101 can further include a through-hole 115, which can extend from the outer surface 107*b* to the inner surface 107*a* of the second member 107.

In certain embodiments, the cinch 101 may be composed of any acceptable material, including but not limited to, rigid or semi-rigid plastics, metals, or carbon fiber materials, which would be known to those of skill in the art. The receptacle 117 may be composed of any acceptable material, including but not limited to, rigid or semi-rigid plastics, metals, or carbon fiber materials, which would be known to those of skill in the art.

In some embodiments, the cinch 101 can be composed of a different material than the receptacle 117. In some embodiments, the cinch 101 can be produced to be a different color than the receptacle 117, or than the body 119 of the receptacle 117. In some embodiments, the cinch 101 can be removable from the body 119 of the receptacle 117. The cinch 101 may be disposed on the body 119 of a receptacle 117 using any suitable attachment means, such as screws, adhesives, or magnetic means. In some embodiments, the attachment means may be detachable attachment means, which can be detached from the cinch 101. In some embodiments, the cinch 101 may further include screw holes 114 disposed in the base member 103, extending from the inner surface 103*a* to the outer surface 103*b*. In some embodiments, the screw holes 114 may each have a beveled edge. Screws may be inserted through the screw holes 114 in the base member 103 of the cinch 101 to attach the cinch 101 to the body 119 of a receptacle 117.

In some embodiments, the cinch 101 may further include internal supports 129, which connect the base member 103 to the side members 106, 108. These internal supports may further strengthen the cinch 101, allowing it to be composed of an inexpensive material, such as a polymer material, yet still be strong enough to be used as a handle to move or lift the receptacle 117.

In some embodiments, the cinch 101 may be removably disposed on the body 119 of a receptacle 117, such that the cinch 101 may be removed from a receptacle 117 by a user and optionally replaced with a new cinch 101. In these embodiments, the cinch 101 may be advantageously disposed on the body of certain receptacles, such as receptacles already in the possession of a user. Additionally, in these embodiments, the cinch 101 could be composed of a different material than the receptacle 117, such as a stronger material, suitable for use in lifting or moving the receptacle using the cinch 101. Additionally, in some embodiments, the cinch 101 can be produced to be a different color than the receptacle 117 or than the body 119 of the receptacle 117. In some instances, producing the cinch 101 to be a different color than the receptacle 117 can allow the user to more easily distinguish the cinch 101 from the receptacle 117, increasing the likelihood that a user will use the cinch 101 to secure a flexible liner 125 to the receptacle 117. Further, in these embodiments, a broken cinch 101 disposed on a receptacle 117 could be replaced with a new cinch 101 without the need to replace the entire receptacle 117, thus reducing waste and extending the useable lifetimes of existing receptacles.

Further, the cinch 101 may simplify use of a receptacle 117 for a user compared to certain receptacles with cinches integrally formed on their bodies. Because base member 103, first member 105, and second member 107 of the cinch 101 can define a handle as described above, a user may use the cinch 101 not only to maintain a flexible liner disposed within the receptacle, but also to lift or move the receptacle 117 using the cinch 101. This can simplify receptacle design, potentially eliminating the need for additional handles disposed on the receptacle body.

One of skill in the art may recognize that the base member 103, first member 105, and second member 107 may be of many different dimensions, so long as they define a space suitable for use as a handle. In some embodiments, the base member 103, first member 105, and second member 107 may define a space having an internal volume of from approximately 1 cubic inch to approximately 10 cubic inches, for example from about 2 cubic inches to about 9 cubic inches, from about 3 cubic inches to about 8 cubic inches, from about 4 cubic inches to about 7 cubic inches, from about 5 cubic inches to about 6 cubic inches, or from about 3 cubic inches to about 5 cubic inches. In some embodiments, the base member 103 has a height from about 0.5 inches to about 4 inches and a width of from about 1 inch to about 10 inches. In one embodiment, the first member 105 has a height of about 2 inches and a width of about 4.75 inches. In some embodiments, the second member 107 has a depth of from about 0.5 inches to about 3 inches and a width of from about 1 inch to about 10 inches. In one embodiment, the second member 107 has a depth of about 1 inch and a width of about 4.75 inches. These internal volumes and cinch dimensions provide sufficient space within the cinch 101 for a user to comfortably insert her fingers and to use the cinch as a handle by which to move the receptacle 117 using the cinch 101, without the need for additional handles disposed on the body 119 of the receptacle 117. In one embodiment, the cinch 101 has a height of about 2 inches, a width of about 4.75 inches, and a depth of about 1 inch.

FIGS. 2A-2D show an embodiment of a receptacle 117 with a cinch 101 which is a handle, as shown in FIGS. 1A-1G. In this embodiment, the receptacle 117 has a body 119 which is configured to receive a flexible liner in an opening 121 surrounded by a rim 123.

Figure 3:
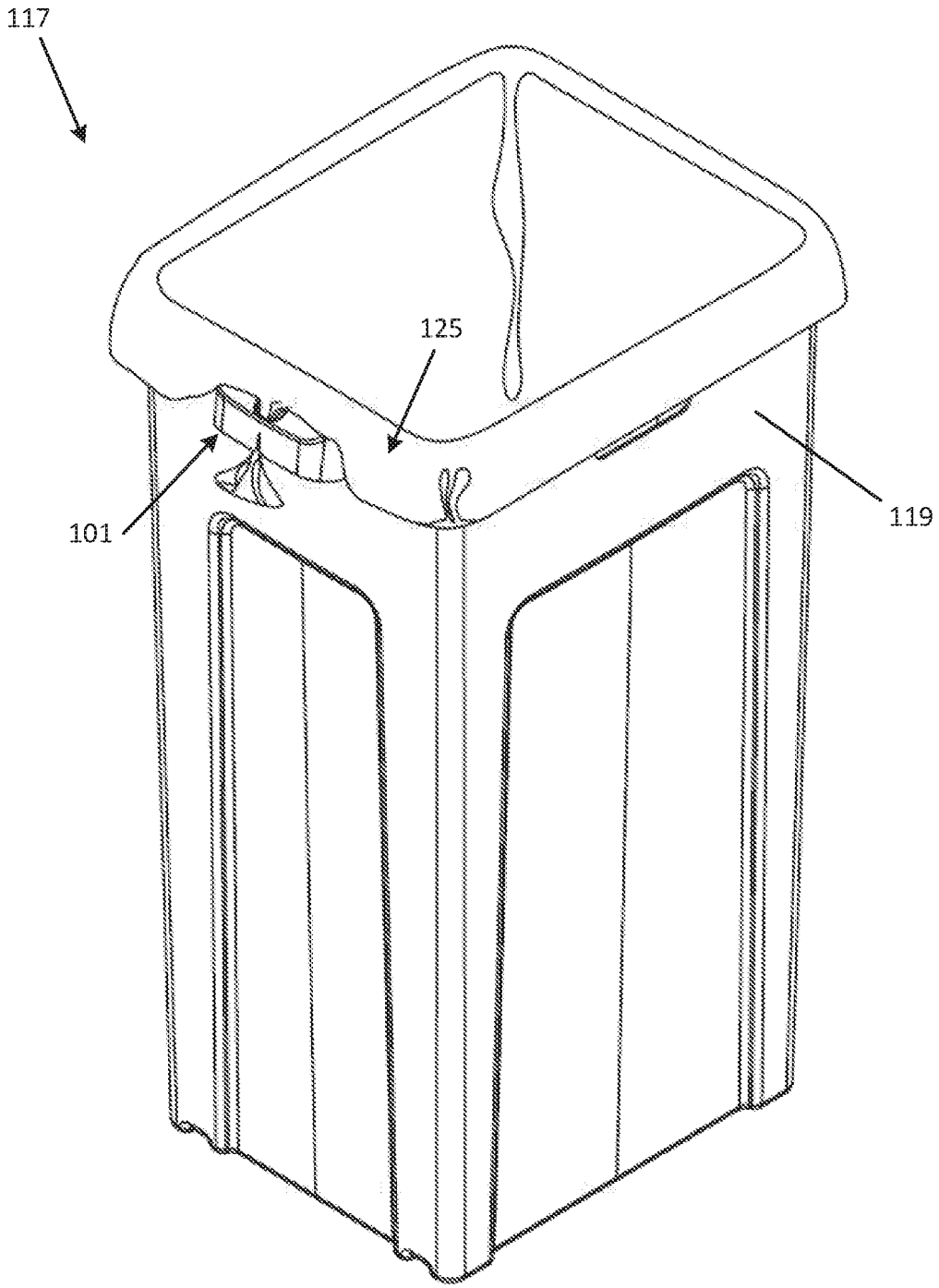
FIG. 3 is a perspective view of the receptacle of FIGS. 2A-2D with a flexible liner disposed within the receptacle and deployed within the cinch.

FIG. 3 shows an embodiment of a receptacle 117 with a cinch 101 which is a handle, as shown in FIGS. 2A-2D, with a flexible liner 125 disposed and retained within the cinch 101.

In some embodiments, a method of using a receptacle is provided. The method can include inserting a flexible liner 125 into a body 119 of the receptacle 117, pulling the flexible liner 125 taut around a rim of the body so as to create a bunched portion from resulting slack, disposing at least one portion of the bunched portion of the flexible liner 125 through the through-hole 115 in the second member 107 and between the slot 109 and the body 119 before disposing the at least one portion of the bunched portion of the flexible liner 125 within the slot 109, and disposing the at least one portion of the bunched portion of the flexible liner 125 between the two side edges of the slot 109 such that the at least one portion of the bunched portion of the flexible liner 125 is retained within the slot 109, as depicted in FIG. 3. In other embodiments, a method of using a receptacle may include inserting a flexible liner 125 into a body 119 of the receptacle 117, pulling the flexible liner 125 taut around a rim of the body so as to create a bunched portion from resulting slack, and disposing the at least one portion of the bunched portion of the flexible liner 125 between the two side edges of the slot 109 such that the at least one portion of the bunched portion of the flexible liner 125 is retained within the slot 109.

Figure 4:
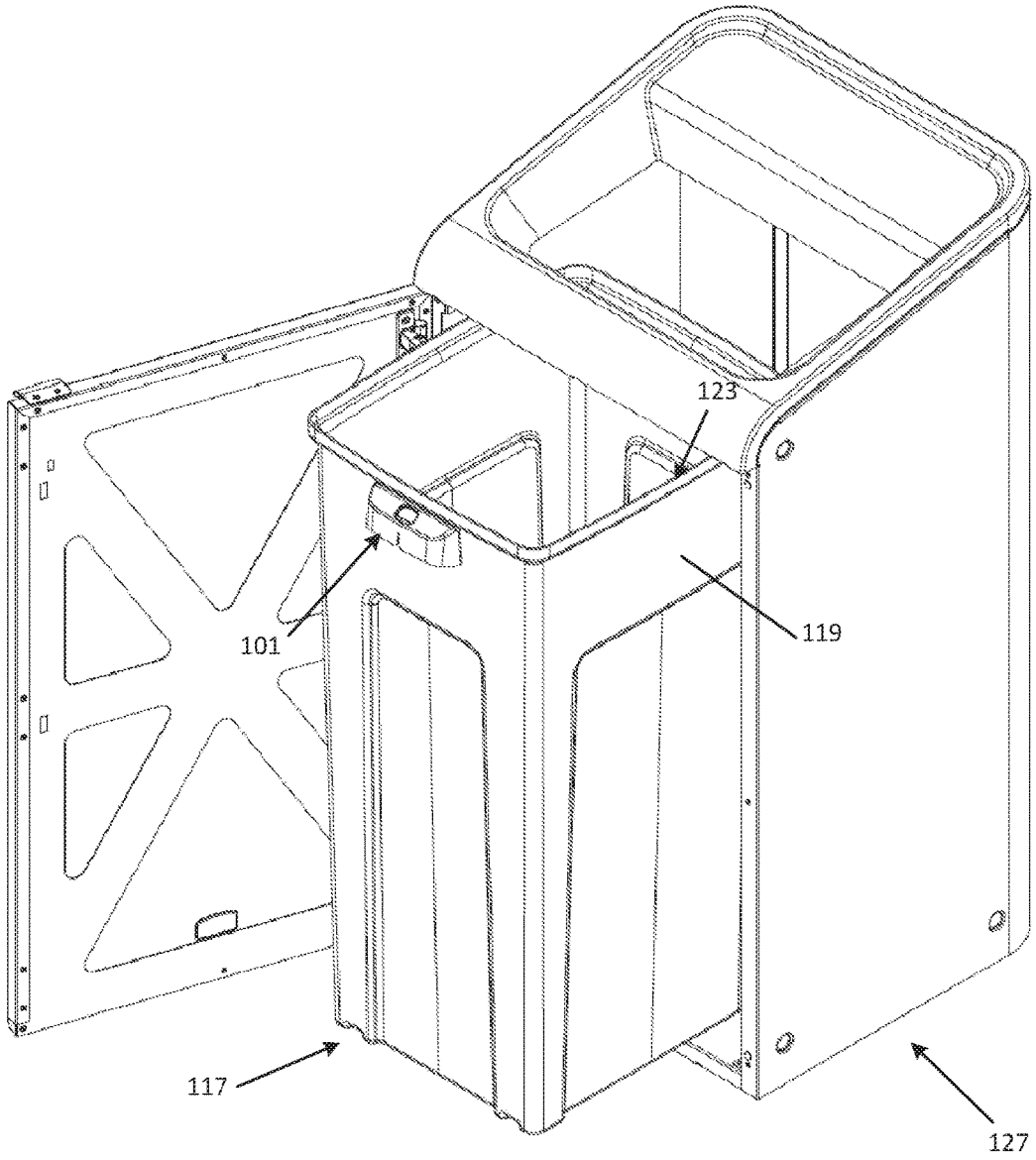
FIG. 4 is a perspective view of the receptacle of FIGS. 2A-2D partially inserted into an open decorative receptacle housing.

In some embodiments, the receptacle 117 may be placed in a decorative receptacle housing 127, as shown in FIG. 4. The decorative receptacle housing 127 may be made of metal, wood, polymers, carbon fiber materials, combinations thereof, or any suitable materials known to those of skill in the art. In these embodiments, the cinch 101 may be used to move the receptacle 117 from and within the decorative receptacle housing 127.

Figure 5A:
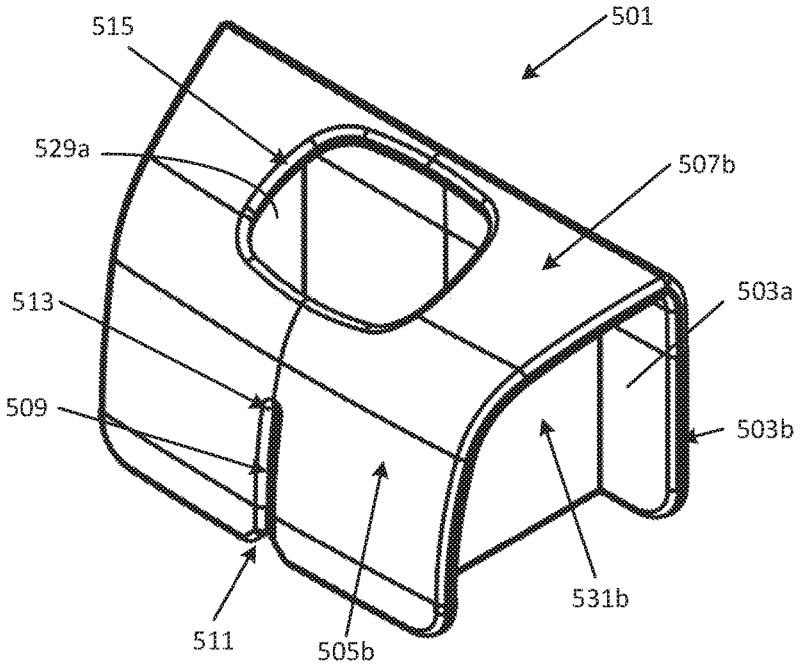
FIG. 5A is a front perspective view of a cinch according to another embodiment.
Figure 5B:
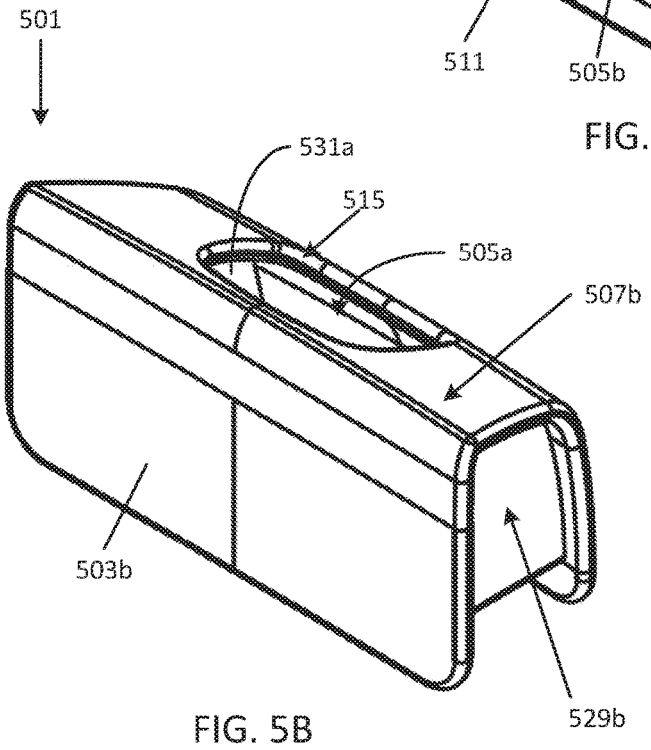
FIG. 5B is a rear perspective view of the cinch of FIG. 5A

FIGS. 5A-5B depict another embodiment of a cinch 501 which is a handle. The cinch 501 can include a base member 503, which is configured to be attachable to the body 519 of a receptacle 517. The base member 503 can have an inner surface 503*a*, which, in use, faces away from the body 519 of the receptacle 517, and an outer surface 503*b*, which, in use, faces toward the body 519 of the receptacle 517.

The base member 503 may be substantially planar, or alternatively, may be curved or faceted. For example, in some embodiments, the base member 503 may be curved to match the curvature of the body of a round receptacle. The cinch 501 can further include a first member 505, which is substantially parallel to the base member 503, and a second member 507, which is substantially transverse to the first member 505. The second member 507 can have an inner surface 507*a* and an outer surface 507*b*. The first member 505 can have an inner surface 505*a* and an outer surface 505*b*. The first member 505 can be connected to the base member 503 via the second member 507. In the illustrated embodiment, the first member 505 can also be connected to the base member 503 via a first side member 529 and a second side member 531, which are substantially perpendicular to the first member 505 and base member 503. The first side member can have an inner surface 529*a* and an outer surface 529*b*, and the second side member can have an inner surface 530*a* and an outer surface 530*b*.

The first member 505 may be substantially planar, or alternatively may be curved or faceted. Similarly, the second member 507 may be substantially planar, or alternatively, may be curved or faceted, such that the second member 507 is at least partially curved or faceted where it is attached to the first member 505 or the base member 503. The first and second side members 529, 531 may be substantially planar, as shown in the embodiments illustrated in FIGS. 5A, 5B, and 6, but could also alternatively be curved or faceted, to more comfortably accommodate the fingers of a user.

The inner surfaces 503*a*, 505*a*, 507*a*, 529*a*, and 531*a* can define a handle. In some embodiments, the base member 503 or the first and second side members 529 and 531 may, at least in certain portions, be shorter than the first member 505. In these embodiments, it will be understood that the handle can be defined by the inner surfaces 505*a*, 507*a*, 503*a*, 529*a*, and 531*a*, and a plane extending perpendicularly from the inner surface 505*a* at its open edge to a plane aligned with the inner surface 503*a*.

The cinch 501 can further include a slot 509, which can extend from the outer surface 505*b* to the inner surface 505*a* of the first member 505. The slot 509 can have an open end 511 and a closed end 513. The cinch 501 can further include a through-hole 515, which extends from the outer surface 507*b* to the inner surface 507*a* of the second member 507.

One of skill in the art may recognize that the base member 503, first member 505, and second member 507 may be of many different dimensions, so long as they define a space suitable for use as a handle. In some embodiments, the base member 503, first member 505, and second member 507 may define a space having an internal volume of approximately from approximately 1 cubic inch to approximately 10 cubic inches, for example from about 2 cubic inches to about 9 cubic inches, from about 3 cubic inches to about 8 cubic inches, from about 4 cubic inches to about 7 cubic inches, from about 5 cubic inches to about 6 cubic inches, or from about 3 cubic inches to about 5 cubic inches. In some embodiments, the base member 503 can have a height from about 0.5 inches to about 4 inches and a width of from about 1 inch to about 10 inches. In one embodiment, the base member 503 can have a height of about 2 inches and a width of about 4.75 inches. In some embodiments, the second member 507 can have a depth from about 0.5 inches to about 3 inches and a width from about 1 inch to about 10 inches. In one embodiment, the second member 507 can have a depth of about 1 inch and a width of about 4.75 inches. These internal volumes and cinch dimensions can provide sufficient space within the cinch 501 for a user to comfortably insert her fingers and to use the cinch 501 as a handle by which to move the receptacle 517, without the need for additional handles disposed on the body 119 of the receptacle 517.

Figure 6:
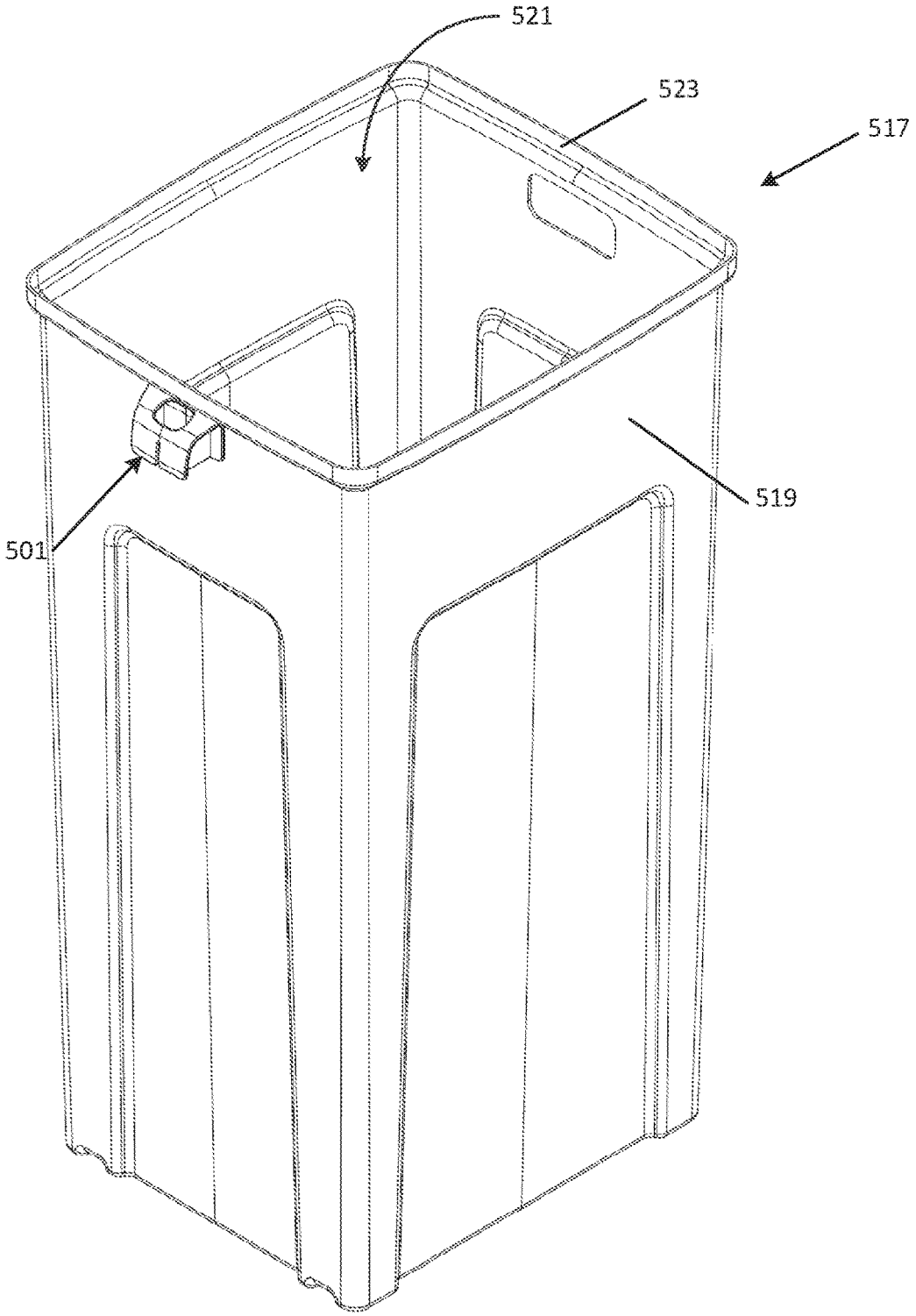
FIG. 6 is an upper perspective view of an embodiment of a receptacle having the cinch of FIGS. 5A-5B disposed thereon.

FIG. 6 shows an embodiment of a receptacle 517 with a cinch 501 which is a handle, as shown in FIGS. 5A-5B. In this embodiment, the receptacle 517 can have a body 519 which is configured to receive a flexible liner in an opening 521 surrounded by a rim 523.

Figure 7A:
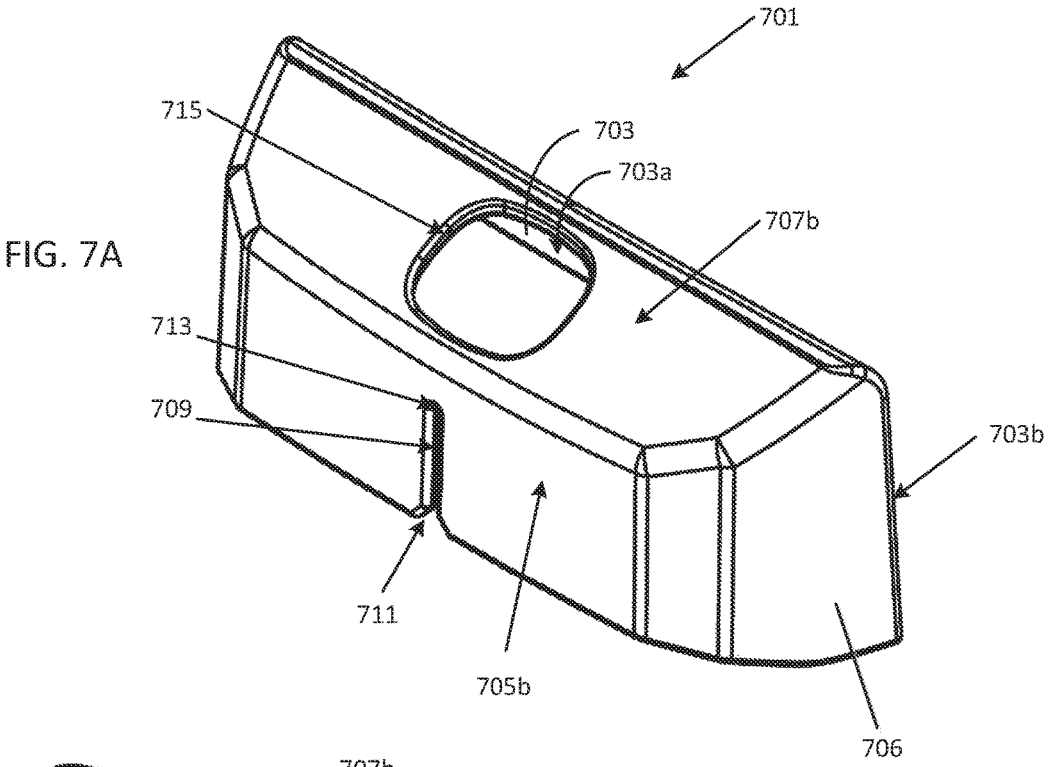
FIG. 7A is a front perspective view of a cinch according to another embodiment.
Figure 7B:
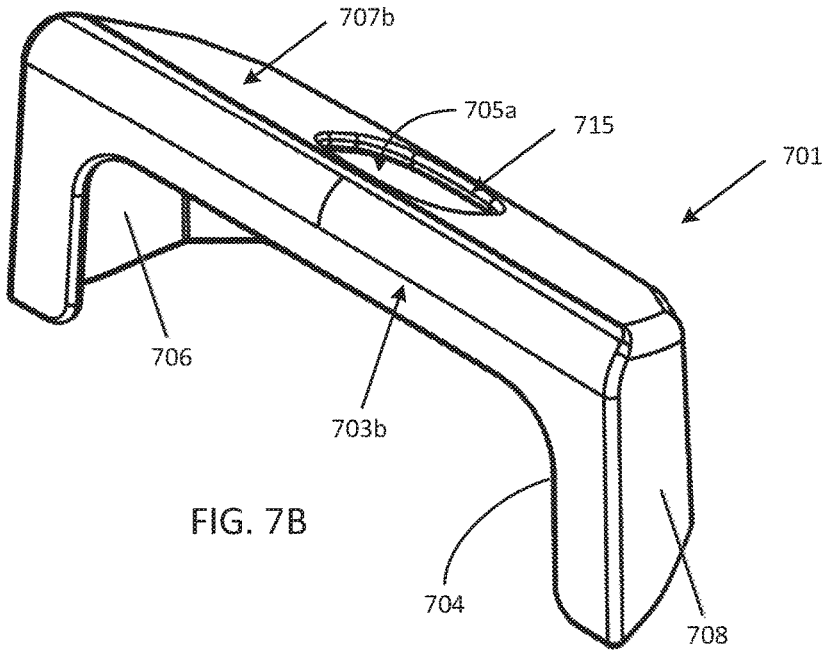
FIG. 7B is a rear perspective view of the cinch of FIG. 7A.

FIGS. 7A-7B depict yet another embodiment of a cinch 701 which can be a handle. The cinch 701 can include a base member 703, which is configured to be attachable to the body 719 of a receptacle 717. For example, in some embodiments the base member 703 may be configured with screw holes through the base member, through which screws can be inserted to attach the cinch to the body of a receptacle. In other embodiments, the base member 703 may be configured with adhesive suitable for attaching the cinch to the body 719 of a receptacle 717. The base member 703 can further have an inner surface 703*a*, which, in use, faces away from the body 719 of the receptacle 717, and an outer surface 703*b*, which, in use, faces toward the body 719 of the receptacle 717. The base member 703 may be substantially planar, or alternatively, may be curved or faceted. For example, in some embodiments, the base member 703 may be curved to match the curvature of the body of a round receptacle. The cinch 701 can further include a first member 705, which is substantially parallel to the base member 703, and a second member 707, which is substantially transverse to the first member 705. The second member 707 can have an inner surface 707*a* and an outer surface 707*b*. The first member 705 can have an inner surface 705*a* and an outer surface 705*b*. The first member 705 is connected to the base member 703 via the second member 707. In the embodiment illustrated in FIGS. 7A, 7B, and FIG. 8, side members 706 and 708 can connect to or may be integrally formed with the first member 705 (i.e., the portion of the cinch substantially parallel to the base member 703) and can further connect the first member 705 to the base member 703. In certain embodiments, the side members 706 and 708, in combination with the first member 705, the second member 707, and the base member 703, can form continuous outer and inner surfaces of the cinch 701.

In certain embodiments, as shown in FIGS. 7A and 7B, the side members 706 and 708 can be substantially flush with the edges of the first member 705, the second member 707, and/or the base member 703. In other embodiments, as discussed above with reference to FIGS. 5A-5B, the side members 529 and 531 may not be flush with the edges of the members, and instead can be spaced from the edges of the members.

In the embodiment illustrated in FIGS. 7A and 7B, the side members 706, 708 can be curved, such that the side members can form a flush outer surface between the first member 705 and the base member 703.

The first member 705 may be substantially planar, or alternatively may be faceted or have another suitable surface feature or contouring. Similarly, the second member 707 may be substantially planar, or alternatively, may be faceted or have another suitable surface feature or contouring. In certain embodiments, rounded or smoothed edge portions can connect the first member 705, the base member 703, the second member 707, and/or any side members 706, 708.

The inner surfaces 703*a*, 705*a*, and 707*a* can define a handle. In some embodiments, the base member 703 may, at least in certain portions, have a height that is shorter than the first member 705, or may not extend along the entire width of the cinch 701. In these embodiments, it will be understood that the handle can be defined by the inner surfaces 705*a*, 707*a*, 703*a*, and a plane extending perpendicularly from the inner surface 705*a* at its open edge to a plane aligned with the inner surface 703*a*. For example, as shown in FIG. 7B, the base member 703 may have a curved or notched bottom edge 704, such that, at least in certain portions along the width of the cinch 701, the base member 703 can be significantly shorter than the first member 705. In these embodiments, it will be understood that the handle can be defined by the inner surfaces 705*a*, 707*a*, 703*a*, and a plane extending perpendicularly from the inner surface 705*a* at its open edge to a plane aligned with the inner surface 703*a*, such that the handle can be defined by a volume which, at least in some portions along the width of the cinch 701, extends beyond the bottom edge 704 of the base member 703. One of skill in the art may recognize that the base member 703, first member 705, and second member 707 may be of many different dimensions, so long as they define a space suitable for use as a handle. In some embodiments, the base member 703, first member 705, and second member 707 may define a space having an internal volume of approximately from approximately 1 cubic inch to approximately 10 cubic inches, for example from about 2 cubic inches to about 9 cubic inches, from about 3 cubic inches to about 8 cubic inches, from about 4 cubic inches to about 7 cubic inches, from about 5 cubic inches to about 6 cubic inches, or from about 3 cubic inches to about 5 cubic inches. In some embodiments, the base member 703 can have a height from about 0.5 inches to about 4 inches and a width of from about 1 inch to about 10 inches. In one embodiment, the base member 703 can have a height of about 2 inches and a width of about 4.75 inches. In some embodiments, the second member 707 can have a depth of from about 0.5 inches to about 3 inches and a width of from about 1 inch to about 10 inches. In one embodiment, the second member 707 can have a depth of about 1 inch and a width of about 4.75 inches. These internal volumes and cinch dimensions can provide sufficient space within the cinch 701 for a user to comfortably insert her fingers and to use the cinch as a handle by which to move the receptacle 717, without the need for additional handles disposed on the body 719 of the receptacle 717.

Figure 8:
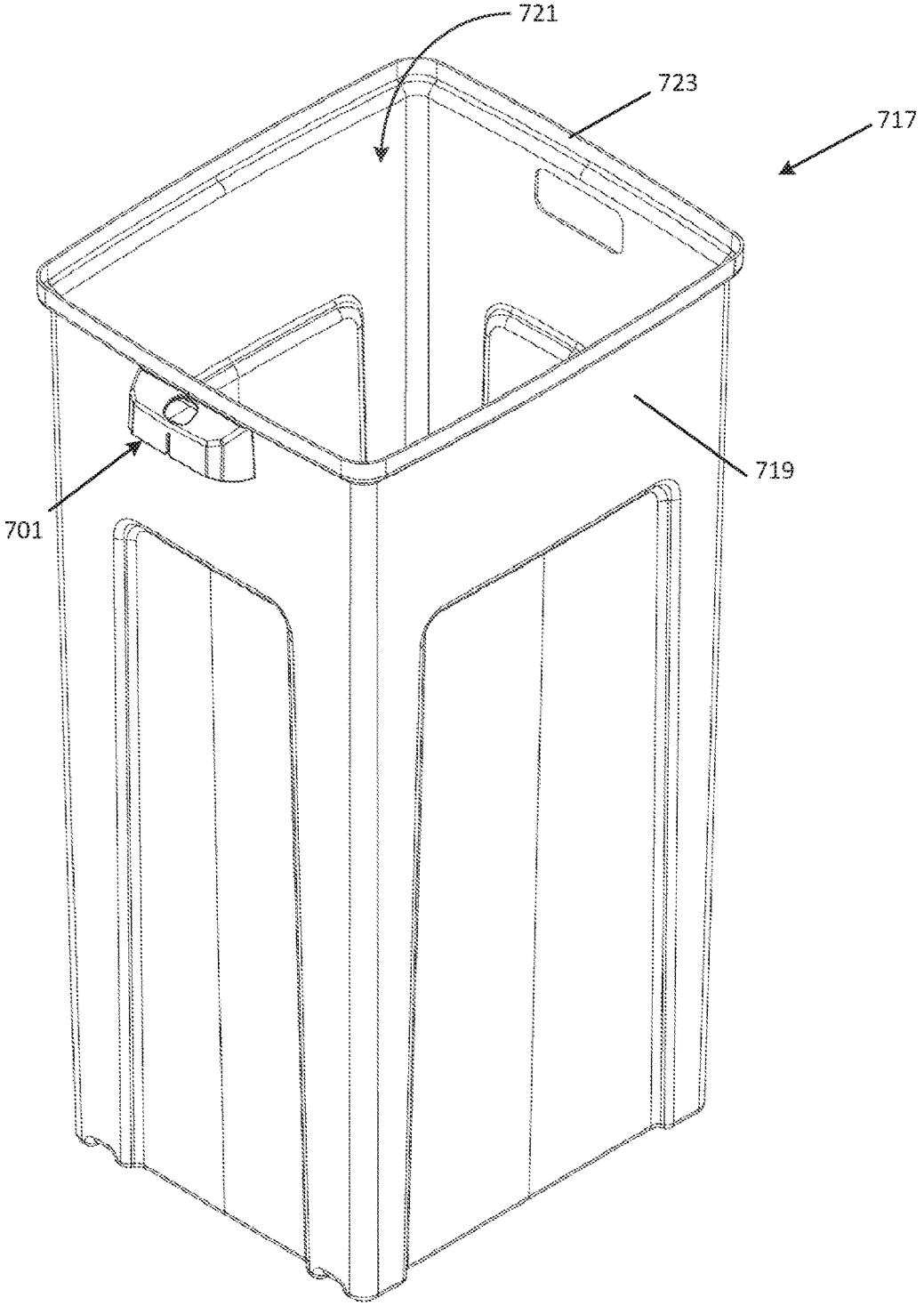
FIG. 8 is a front perspective view of an embodiment of a receptacle having the cinch of FIGS. 7A-7B disposed thereon.

FIG. 8 shows an embodiment of a receptacle 717 with a cinch 701 which is a handle, as shown in FIGS. 7A-7B. In this embodiment, the receptacle 717 can have a body 719 which is configured to receive a flexible liner in an opening 721 surrounded by a rim 723.

Modifications and variations of the structures and methods described herein will be recognizable and/or apparent to those skilled in the art from the foregoing detailed description. It is intended that the specification and examples be considered as exemplary only. It will be apparent to those skilled in the art that various modifications and variations can be made to present receptacles, cinches, and methods without departing from the scope of the invention, and such modifications and variations are intended to come within the scope of the appended claims.

What is claimed:

1. A receptacle, comprising:

a body configured to receive a flexible liner; and at least one cinch disposed on the body, the cinch comprising:

a base member selectively removable from the body;

a projection disposed outward of the body, wherein the projection comprises a first member spaced apart from the base member, a second member, a first side member, and a second side member, the first member being substantially parallel to the body, the second member being substantially transverse to the first member, and the first member being connected to the base member via the second member, the first side member, and the second side member, wherein each of the base, first and second members, and first and second side members has opposed outer and inner surfaces such that the inner surface of the base member faces away from the body, the inner surface of the first member faces the body, and the inner surface of the second member faces a space defined by the base member, first member, and second member, and wherein the inner surfaces of the base member, first side member, second side member, first member, and second member define a handle having a width and a depth capable of receiving a user's fingers;

a slot extending from the inner surface to the outer surface of the first member, wherein the slot has an open end at a bottom edge of the first member, a closed end disposed between the bottom edge and a top edge of the first member, and two side edges extending between the open end and the closed end, wherein the two side edges of the slot are substantially parallel to one another such that at least one portion of a flexible liner is disposable and retainable within the slot by the two side edges; and a through-hole in the second member, the through-hole being configured to receive therethrough a portion of the flexible liner adjacent the at least one portion of a flexible liner disposed and retained within the slot, wherein the at least one cinch comprises the sole handle protruding from the body, and wherein the handle is configured to receive the fingers of a user.

2. The receptacle of claim 1, wherein the through-hole has a closed continuously-curved periphery.

3. The receptacle of claim 1, wherein the cinch is removable from the body via detachable attachment means.

4. The receptacle of claim 1, wherein the handle defined by the inner surfaces of the base member, side members, first member, and second member has an inner volume of about 1 cubic inch to about 10 cubic inches.

5. The receptacle of claim 1, wherein:

the outer surface of the base member has a height of from about 0.5 inches to about 4 inches and a width of from about 1 inch to about 10 inches; and the outer surface of the second member has a depth of from about 0.5 inches to about 3 inches and a width of from about 1 inch to about 10 inches.

6. The receptacle of claim 1, wherein the receptacle is a different color than the cinch.

7. The receptacle of claim 1, wherein the receptacle is composed of a different material than the cinch.

8. A cinch, comprising:

a base member configured to be selectively attached to a body of a receptacle, such that an outer surface of the base member faces toward the body of the receptacle and is configured to match a planar or curved surface of the body of the receptacle;

a first member spaced apart from the base member and substantially parallel to the base member;

a second member that extends outwardly from the base member and is substantially transverse to the first member, wherein the first member is connected to the second member and the second member is connected to the base member and wherein each of the base, first, and second members has opposing outer and inner surfaces such that the inner surface of the base member faces the first member, the inner surface of the first member faces the base member, and the inner surface of the second member faces a space defined by the base member, first member, and second member;

first and second side members connecting the base member and the first member, the first and second side members forming a continuous outer surface of the cinch with the base, first, and second members;

a slot extending from the inner surface to the outer surface of the first member, wherein the slot has an open end at a bottom edge of the first member, a closed end disposed between the bottom edge and a top edge of the first member, and two side edges extending between the open end and the closed end, wherein the two side edges of the slot are substantially parallel to one another such that at least one portion of a flexible liner positioned the body of the receptacle is disposable and retainable within the slot by the two side edges; and a through-hole in the second member that is configured to receive therethrough a portion of the flexible liner adjacent the at least one portion of a flexible liner disposed and retained within the slot, wherein the inner surfaces of the base member, first member, and second member define a handle configured to receive the fingers of a user.

9. The cinch of claim 8, wherein the through-hole has a closed continuously-curved periphery.

10. The cinch of claim 8, further comprising a first side member and a second side member, wherein the first member is connected to the base member via the second member, the first side member, and the second side member.

11. The cinch of claim 8, wherein the handle defined by the inner surfaces of the base member, first member, and second member has an inner volume of about 1 cubic inch to about 10 cubic inches.

12. The cinch of claim 8, wherein:

the outer surface of the base member has a height of from about 0.5 inches to about 4 inches and a width of from about 1 inch to about 10 inches; and the outer surface of the second member has a depth of from about 0.5 inches to about 3 inches and a width of about 1 inch to about 10 inches.

13. A method of using a receptacle, comprising:

inserting a flexible liner into a body of the receptacle, the receptacle comprising a cinch disposed on the body, wherein the cinch comprises:

a base member selectively removable from the body;

a projection disposed outward of the body, wherein the projection comprises first and second members, the first member being substantially parallel to the body and spaced apart from the base member, the second member being substantially transverse to the first member, wherein the first member is connected to the second member and the second member is connected to the base member, wherein each of the base, first, and second members has opposed outer and inner surfaces such that the inner surface of the base member faces away from the body, the inner surface of the first member faces the body, and the inner surface of the second member faces a space defined by the base member, first member, and second member, and wherein the inner surfaces of the base member, first member, and second member define a handle;

a slot extending from the inner surface to the outer surface of the first member, wherein the slot has an open end at a bottom edge of the first member, a closed end disposed between the bottom edge and a top edge of the first member, and two side edges extending between the open end and the closed end, wherein the two side edges of the slot are substantially parallel to one another; and a through-hole in the second member, pulling the flexible liner taut around a rim of the body so as to create a bunched portion from resulting slack;

disposing at least one portion of the bunched portion of the flexible liner through the through-hole in the second member and between the slot and the body before disposing the at least one portion of the bunched portion of the flexible liner within the slot; and disposing the at least one portion of the bunched portion of the flexible liner between the two side edges of the slot such that the at least one portion of the bunched portion of the flexible liner is retained within the slot, wherein the cinch comprises the sole handle disposed on the body, and wherein the handle is configured to receive the fingers of a user.

14. The method of claim 13, wherein the cinch is attached to the body with one or more screws.

15. The method of claim 13, wherein the cinch is attached to the body with adhesive.

16. The method of claim 13, further comprising using the handle to lift the receptacle.

17. The method of claim 13, wherein the handle defined by the inner surfaces of the base member, first member, and second member has an inner volume of about 1 cubic inch to about 10 cubic inches.

18. The method of claim 13, wherein:

the outer surface of the base member has a width of from about 0.5 inches to about 4 inches and a length of from about 1 inch to about 10 inches; and the outer surface of the second member has a width of from about 0.5 inches to about 3 inches and a length of about 1 inch to about 10 inches.

19. The receptacle of claim 1, wherein the base member comprises an outer surface configured to match a planar or curved surface of the body of the receptacle.

20. The method of claim 13, wherein the base member comprises an outer surface configured to match a planar or curved surface of the body of the receptacle.

* * * * *